United States Patent [19]

Raab

[11] 4,121,308

[45] Oct. 24, 1978

[54] WATER CLOSET WATER SAVING DEVICE

[75] Inventor: Clifford Raab, Gardena, Calif.

[73] Assignee: Displacement Systems Corporation, Torrance, Calif.

[21] Appl. No.: 790,145

[22] Filed: Apr. 22, 1977

[51] Int. Cl.[2] ..... E03D 1/00; A47K 17/00

[52] U.S. Cl. ..... 4/415; 4/1

[58] Field of Search ..... 4/67 A, 34, 67 R, 1, 4/18, 415

[56] References Cited

U.S. PATENT DOCUMENTS

| | | | |
|---|---|---|---|
| 3,334,359 | 8/1967 | Weingartner | 4/67.4 |
| 3,877,081 | 4/1975 | Ktain | 4/1 |
| 3,939,887 | 2/1976 | Scarnato | 150/0.5 |
| 3,939,888 | 2/1976 | Scarnato | 150/0.5 |
| 3,982,282 | 9/1976 | Kong | 4/1 |

*Primary Examiner*—Henry K. Artis

*Attorney, Agent, or Firm*—Lindenberg, Freilich, Hornbaker, Wasserman, Rosen & Fernandez

[57] ABSTRACT

There is disclosed a water closet water saving device comprising a container consisting of flexible material and having one or more accordion-like pleats formed in the wall of the container. The pleats enable recoverable compression of the container along an axis perpendicular to the plane of the pleats. The container is shaped so that it may be positioned within any conventional water closet in a manner such that it does not interfere with the operation of the tank equipment.

4 Claims, 3 Drawing Figures

FIG. 2
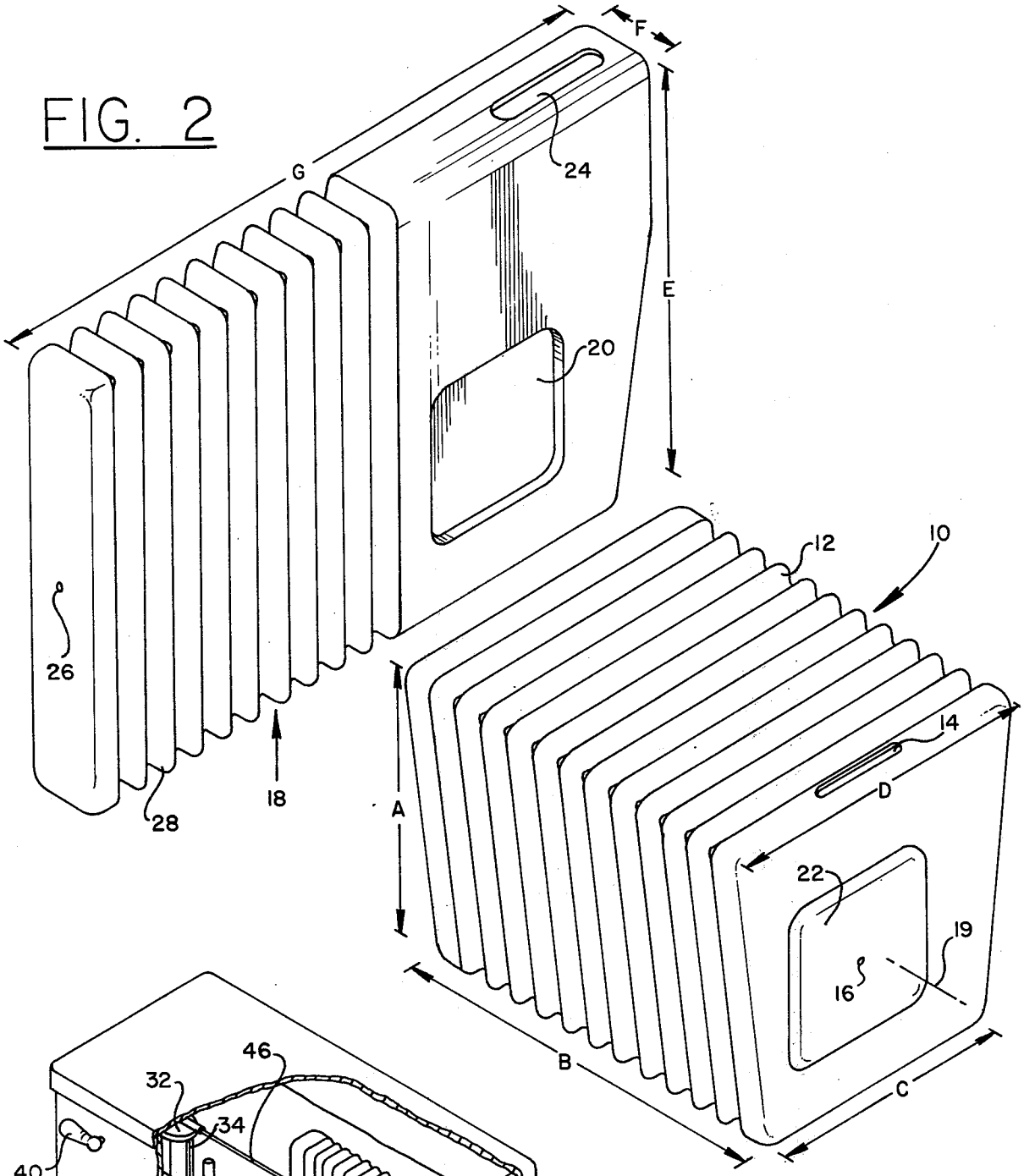
FIG. 1
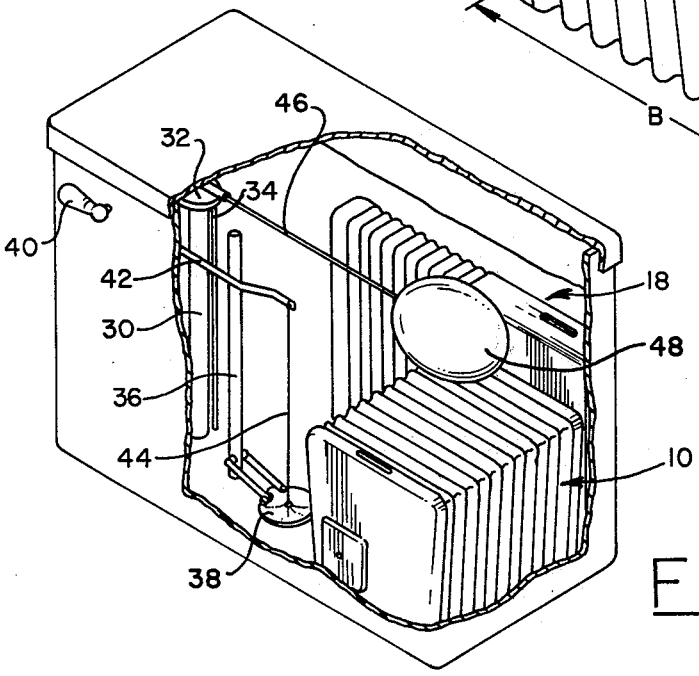
FIG. 3

WATER CLOSET WATER SAVING DEVICE

BACKGROUND OF THE INVENTION

The present invention relates to a water closet water saving device and, in particular, relates to a device for reducing the amount of water used during the flushing operation of a water closet.

In recent years, there has been a growing concern over the waste of one of our most abundant natural resources water. In some areas of the country, there is an insufficient supply of clean water to fill all of the rapidly expanding industrial, agricultural and domestic water needs. Further, in populated urban areas, wasteful use of large amounts of water causes overloading of sewage treatment plants. In some cases, this overloading leads to a discharge of improperly treated effluents into the water courses, thereby causing problems for downstream areas.

During normal household water usage, it has been discovered that a great deal of clean water is unnecessarily poured into the sewage system. For example, approximately 42% of domestic water usage is used in the flushing of toilets. The average flush tank of conventional water closets contains approximately 5.25 gallons of water. It has been discovered that substantially less water is required to properly flush the water closet and, thus, large quantities of fresh water are wasted during the flushing operation.

One prior solution to this problem involved placement of a barrier at the bottom of the flush tank to retain water within the tank during the flushing operation. Unfortunately, the barrier caused a loss of static head during the flushing operation, thereby resulting in an unsuitable flush.

Other prior solutions to this problem consisted of modifications to the flush tank or the flush valve control mechanism to reduce the amount of water used per flush. While these modifications reduced the amount of water consumed during a flush, they were generally costly and required disassembly of the toilet for installation, thereby, in many cases, requiring the service of the plumber.

Another prior solution to the problem involved the placement of objects such as bricks, plastic bottles or a flexible plastic bag filled with water in the flush tank to displace some of the water within the tank. In some cases, the bricks disintegrated after a period of soaking in the flush tank and the resulting particles of clay interfered with the operating mechanism of the tank. Further, in some cases, the flexible bag which was normally secured to the wall of the tank deformed during the flushing operation to interfere with the operating mechanism of the water closet. Also, both the plastic bottles and the plastic bag which in some cases became displaced from the wall of the water closet, were able to move freely within the water tank. This movement within the tank eventually caused the bottles or bag to interfere with the operating mechanism of the tank. Further, in some cases, the bag was ruptured and carried into the outlet of the water closet.

It is, therefore, the object of the present invention to provide a water closet water saving device that is inexpensive and simple to install in any conventional water closet.

It is a further object of the present invention to provide a water closet water saving device comprising a container which is capable of being secured without external support within a conventional water closet to avoid interfering with the operation of the tank equipment.

It is another object of the present invention to provide a water closet water saving device which is adjustable to enable it installation in various sized water closets.

These and other objects and advantages are obtained by forming a water closet water saving device comprising a container consisting of flexible material and having one or more pleats formed in the wall of the container. The container preferably consists of a flexible plastic material and is preferably provided with a plurality of generally accordion-like pleats extending completely around the outside of the container. Preferably, the entire length of the container is provided with pleats. The pleats enable recoverable compression of the container along an axis perpendicular to the plane of the pleats. The container is shaped so that it may be positioned within any conventional water closet in a manner such that it does not interfere with the operation of the tank equipment. To install the container, the container is preferably first compressed along the axis perpendicular to the plane of the pleats to enable its installation without interfering with the tank equipment. The device is then preferably positioned at the side of the flush tank to avoid interfering with the operation of the tank equipment. After the container is positioned in the tank, the container will expand along the axis of compression until it contacts the side of the tank. This expansion biases the container between the walls of the tank and therefore enables the container to be secured during the flushing operation without the need for external supports.

In an alternative embodiment, the container of the present invention is utilized in combination with a second vessel. The second vessel is provided with means to enable it to be interlocked with the container to secure it in the flush tank.

A more thorough disclosure of the objects and advantages of the present invention is presented in the detailed description which follows and from the accompanying drawings in which:

FIG. 1 is a perspective view of a water saving device formed according to the present invention;

FIG. 2 is a perspective view of a vessel for use in combination with the container of the present invention; and FIG. 3 is a perspective view partially in section of the container of the present invention interlocked with a second vessel and positioned within the flush tank of a conventional water closet.

DESCRIPTION OF THE PREFERRED EMBODIMENT

The present invention contemplates the formation of a water closet water saving device comprising a container consisting of a flexible material and having one or more pleats formed in the wall of the container. The container preferably consists of a flexible plastic material such as polyethylene, polypropylene or polyvinyl chloride. However, it will be obvious to one skilled in the art that other suitable materials may also be utilized in the practice of the present invention.

Referring to FIG. 1, there is shown a preferred embodiment of the water saving device of the present invention comprising generally container 10 having a plurality 12 of pleats formed in the wall thereof. The container has a generally rectangular configuration. However, it will be obvious to one skilled in the art that the container may be manufactured in other configurations to enable its proper installation into the flush tank. The pleats are preferably generally accordion-like being parallel and juxtaposed and preferably extend completely around the container and along the entire length of the container.

The plurality of pleats 12 enable the container to be compressed into a compact structure along axis 18. The compressed container may be positioned within any conventional water closet, such as those manufactured by American Standard, Norris, Universal-Rundle, Western Ceramics and Kohler, without the need to disassembly any of the operating mechanism.

The container is also provided with a first aperture 14 positioned at the top of the container to enable the introduction of water into the interior of the container. The container is also preferably provided with a second aperture 16 disposed at the side of the container to permit discharge of a small amount of water from the container during the flushing operation to prevent stagnation of the water in the container.

Preferably, the container of the present invention is used in combination with a second vessel. Referring to FIG. 2, there is shown a suitable second vessel 18 for use with the container of the present invention. The vessel 18 is preferably provided with a recess 20 capable of receiving a corresponding, outwardly projecting protrusion 22 formed in the wall of container 10. The vessel is also preferably provided with a first aperture 24 formed at the top thereof to enable the vessel to be filled with water and a second aperture 26 at the side thereof to enable the discharge of a small amount of water during the flushing operation. The vessel may also be provided with one or more pleats 28. These pleats function to provide the second container with flexibility to facilitate its installation into the flush tank.

In its most preferred embodiment, the container and the vessel have the following approximate dimensions:

A — about 5 inches
B — about 12 inches
C — about 5 inches
D — about 6 inches
E — about 8 inches
F — about 1 inch
G — about 12 inches The container preferably holds approximately 1 gallon or more of water and the vessel preferably holds about ¾ of a gallon or more of water. Referring to the dimensions and specifically to dimension C and D, it should be noted that the container is provided with sloping sides to enable it to be positioned in flush tanks having sloping walls.

Referring to FIG. 3, there is shown the preferred embodiment of the container formed according to the present invention interlocked with a second vessel and disposed within the flush tank of a conventional water closet.

The flush tank is typically provided with a conventional flushing mechanism consisting of an inlet tube 30, an inlet valve 32, a filler tube 34, an overflow tube 36, a plug 38, a trip handle 40, a trip arm 42, a trip chain 44, a float arm 46 and a float ball 48.

In operation, flushing is accomplished as trip arm 42 is activated by depressing trip handle 40, causing trip chain 44 to open plug 38, permitting stored water in the water closet to flow turbulently into the bowl to effect vacuation. Once the water has reached the minimum level, plug 38 is closed. Inlet valve, which was opened when float ball 48 began to fall with the exiting water, allows incoming water to refill the tank through filler tube 34. When the water reaches a predetermined level, float ball 48 closes inlet valve 32 and the closet is ready for its next use.

It can be seen from the drawing that the vessel 18 is positioned so that it does not interfere with the downward travel of the float ball 48 during the flushing operation of the closet. Further, it can be seen that the container is positioned so that it occupies the maximum amount of area at the bottom of the flush tank without interfering with the operation of the tank equipment. During the flushing operation, float ball 48 falls until it encounters container 10 and then rests on the container until the water level rises again.

The container of the present invention is installed in the flush tank by first compressing the container along axis 19 to enable it to be moved past float ball 48. The container is placed at the side of the flush tank as shown so that it does not interfere with the operation of the flush mechanism. Upon release of the compressive force, the container expands along axis 19 back to its original configuration. In the expanded configuration, the container is biased between the walls of the flush tank to prevent is displacement during the flushing operation.

In an alternative embodiment, the container and the vessel are both installed in the flush tank. In this embodiment, the container is first placed into the flush tank as described above. The vessel is then placed into the flush tank. Depending upon the location of the overflow valve 36 and plug 38, the vessel 18 is positioned along the front or the back of the flush tank as shown so that it does not interfere with the operation of the flush mechanism. To interlock the vessel in the container, the container is compressed slightly along axis 19 to enable the vessel to be moved between the container and the wall of the flush tank. Upon release of the compressive force, the container expands along axis 19 to force protrusion 22 of container 10 into recess 20 of the vessel 18, thereby interlocking the container in the vessel. In this position, the container biases the vessel against the wall of the flush tank and thereby secures both the container and the vessel in the flush tank to prevent displacement of the container and the vessel during the flushing operation.

The container of the present invention requires no external supports to secure it in the flush tank during the flushing operation. Further, the container can expand to fit various sized flush tanks thereby enabling its use in most water closets.

While an embodiment and application of this invention has been shown and described, it will be apparent to those skilled in the art that many more modifications are possible without departing from the inventive concepts herein described. The invention, therefore, it not to be restricted except as is necessary by the prior art and by the spirit of the appended claims.

I claim:

1. A container for reducing water consumption during the flushing of a water closet having a water inlet valve at one end and a water output valve at the center, said container comprising a pleated hollow and substantially rectangular prism made of impervious flexible material and having the pleats thereof disposed in vertical planes between ends of said container, and an aperture formed at the top of said container to enable water to fill the container when it is placed in said water closet on the bottom thereof with said pleats partially compressed to enable its installation between front and back walls of said water closet at one end thereof remote from said water inlet valve without interfering with operation of the water inlet valve or operation of said water outlet valve said pleated container having a demension in a direction normal to the plane of said pleats greater than the distant between said front and back walls to require said pleats to be compressed upon installation of said container, whereby the partially compressed pleated walls will hold said container in place as said water closet empties out and refills during a flushing operation.

2. A container as defined in claim 1 including an aperture formed in a wall and below the top of said container to permit discharge of a small amount of water therefrom during the flushing operation thereby to prevent stagnation of water in the container.

3. The combination as defined in claim 1 including a vessel comprising a hollow and substantially rectangular prism, said vessel having a height greater than width and a length greater than the height, where said vessel height is at least equal to the height of said container to permit said vessel to be placed between said container and one wall of said water closet with said length parallel to said one wall of said water closet, and an aperture formed at the top of said vessel to enable water to fill the vessel.

4. The combination as defined in claim 3 including an aperture formed in a wall and below top of said container to permit discharge of a small amount of water therefrom during the flushing operation thereby to prevent stagnation of water in the container prism and an aperture formed in a wall and below the top of said vessel to permit discharge of a small amount of water therefrom during the flushing operation thereby to prevent stagnation of water in the vessel prism.

* * * * *